US005130956A

United States Patent [19]

Ueda

[11] Patent Number: 5,130,956

[45] Date of Patent: Jul. 14, 1992

[54] CLOCK

[76] Inventor: Masahiro Ueda, 3-12, Mitsugarasu 5-chome, Nara-Shi, Nara, Japan

[21] Appl. No.: 694,100

[22] Filed: May 1, 1991

[30] Foreign Application Priority Data

Jul. 17, 1990 [JP] Japan ..... 2-189141

[51] Int. Cl.[5] ..... G04B 19/04

[52] U.S. Cl. ..... 368/81; 368/238

[58] Field of Search ..... 368/76, 80, 81, 220, 368/223, 228, 238, 47

[56] References Cited

U.S. PATENT DOCUMENTS

| | | | |
|---|---|---|---|
| 407,945 | 7/1889 | Speer | 368/81 |
| 462,000 | 10/1891 | Fellinger | 368/81 |
| 517,594 | 4/1894 | Smith | 368/81 |
| 781,505 | 1/1905 | Engle | 368/81 |
| 3,852,953 | 12/1974 | Mischiatti | 368/47 |
| 4,023,344 | 5/1977 | Mukaiyama | 368/47 |
| 4,676,662 | 6/1987 | Sekido | 368/238 |
| 5,025,429 | 6/1991 | Watanabe | 368/238 |

*Primary Examiner*—Vit W. Miska

*Attorney, Agent, or Firm*—Burns, Doane, Swecker and Mathis

[57] ABSTRACT

A driving mechanism is arranged in a hand for relatively rotating the hand in relation to a shaft which supports the hand, and clocking is thereby performed.

6 Claims, 5 Drawing Sheets

CLOCK

BACKGROUND OF THE INVENTION

1. Field of the Invention

The present invention relates to a large-sized clock such as the one which is principally installed on the exterior of a building or a flower clock which is installed outdoors.

2. Description of Related Art

The clock of this kind is known well as flower clock, tower clock and the like. Conventionally, a long hand, short hand and second hand of the clock are disposed on the surface of a wall or on the surface of the ground, and the hands are connected with and supported by a driving mechanism which is installed in the wall or in the inner surface of the wall or in the ground or the like. The driving mechanism is manufactured in one unit of a device composed of driving sections which generate different movements of each hand to provide each one of the hands with necessary movement.

It is, however, necessary for the conventional clock to install the driving device in a wall or in the ground or in the inner surface of a wall, and the driving shafts used therein have to be stretched out onto the surface of the wall or outside of the ground in order to connect the hands to each one of the driving shafts. A large-scale operation is, therefore, required to install the driving mechanism, and considerable time and labor are consumed.

Moreover, it is hard to handle the driving device installed in the ground or in the wall and inconvenient for checking and maintenance operations. Since the driving device is made up in one unit which is composed of the driving mechanisms of each hand, even one hand gets out of order, the whole structure of the driving device has to be checked, and the operation becomes unnecessarily complicated.

In the case of a flower clock, for instance, flower can not be planted around the central part of the clock since driving section is buried in the ground thereat. In the case of a tower clock, an operation room has to be provided at the back of the clock for checking and maintenance operations.

Furthermore, it requires very long hands, and the portion of leading end side of a hand extending from rotative shaft section becomes remarkably long and heavy as compared with the portion of tail end side. The weight is therefore not balanced well between the leading end portion and the tail end portion, and smooth rotation can not be expected. In order to solve the problem, it is necessary to adjust the weight balance by housing a weight in the tail end portion. The structure thus becomes complicated to make it hard to install, and it eventually necessitates expensive cost for manufacturing and installation operation. The built-in balancer makes the weight of the whole body heavier and it invites disadvantages to transport and installation operations.

SUMMARY OF THE INVENTION

A main object of the present invention is to provide a clock wherein driving mechanisms are skillfully mounted by making good use of hands so that installation, checking and maintenance operations can be easily performed without the necessity of providing an operation room at the back of the clock in the case of a tower clock, and in the case of a flower clock, flower can be planted even at the location around the central part of the clock.

Another object of the present invention is to provide a clock wherein a driving mechanism is mounted in a hand for rotatively driving the hand which is rotatably supported by a shaft so that the driving mechanism and its driving shaft and hand are independently located outside the location of installation for driving the hand whereby installation, checking and maintenance operations can be easily performed since any special driving space is not required.

A still another object of the present invention is to provide an inexpensive and long-life clock which is simple in structure wherein a driving mechanism is housed in a hand so that the exposure to the outside is prevented without a need of any special case, and the appearance is not marred.

A further object of the present invention is to provide a low-cost clock which is equipped with further simplified structure wherein a driving source is arranged in one of the driving mechanisms that are provided in each one of the hands whose speed of rotatiion is different from each other, and by connecting the driving mechanisms about the shafts in such a way to satisfy the speed ratio of mutual driving mechanisms, the driving mechanism of each hand can be actuated by the driving source.

A still further object of the present invention is to provide a power-saving type clock in simple wiring construction by arranging a solar panel as power source for a driving source on the upper surface of the hand in which a driving mechanism is provided.

A still another object of the present invention is to provide a high-precision and lightweight clock which is simple in structure wherein a driving mechanism is mounted in the location extending from the driving shaft section to the tail end section of a hand so that the weight balance of the hand in long length can be satisfied without using any special balancer.

These and other objects and features of the present invention will become more apparent from the following description taken in conjunction with the preferred embodiments thereof with reference to the accompanying drawings.

DESCRIPTION OF THE PREFERRED EMBODIMENTS

Figure 1:
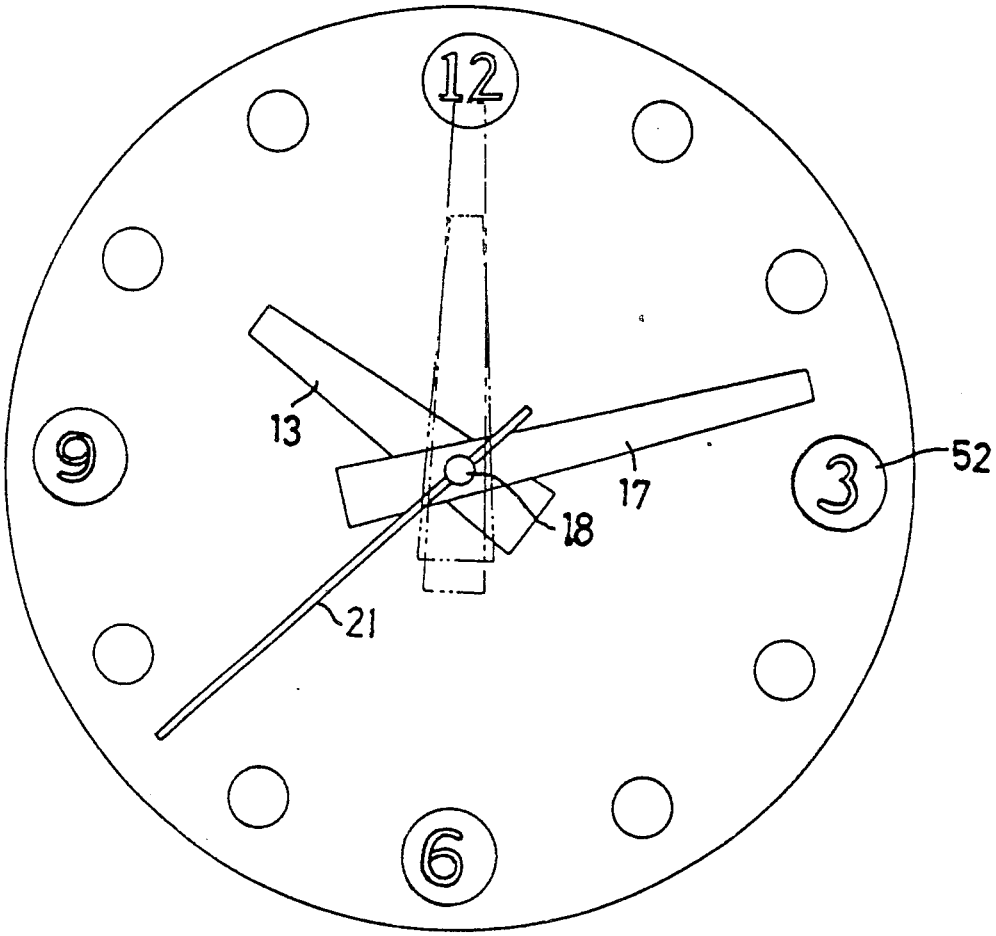
FIG. 1 is a front view showing an example of a flower clock to which the present invention is applied.

Typical embodiments of the present invention will now be described below referring to the accompanying drawings.

FIGS. 1 through 4 show an example of a flower clock to which the present invention is applied. The clock is installed on an upward base 4 shown in the FIG. 2. In the case of the flower clock, the base 4 is the ground itself or a base is installed in the ground, and in the case of a clock which is installed on the exterior of a building, the base 4 is the surface of a wall itself or a base is installed on the surface of a wall. As shown in the FIGS. 1 and 2, the clock is a large-sized clock suitable for use outdoors and is provided with a second hand 21, long hand 17 and short hand 13. A shaft 5 is erected on the base 4 by a metal fitting 6 as illustrated in the figure. About the periphery of the shaft 5, a countershaft 7 is fitted thereon and fixed by a bolt 8.

At the outside of a lower half portion of the countershaft 7, a short hand shaft 9 is fitted thereon and rotatably supported by bearings 10 and 11 so as to be rotated independently. At the upper end of the short hand shaft 9, there is fixed the short hand 13. At the outside of upper half portion of the countershaft 7, a long hand shaft 14 is rotatably fitted thereon and is supported by bearings 15 and 16 so as to be rotated independently. At the upper end of the long hand shaft 14, there is fixed the long hand 7. On the upper surface of the long hand 17, there is disposed a minute hand shaft 18 concentrically with the long hand 17, and the shaft is rotatably supported by bearings 19 and 20 so as to be rotated independently. The minute hand 21 is fixed on the upper end of the minute hand shaft 18.

The long hand 17 and short hand 13 are formed hollow. In the tail end portion of the long hand 17, there are provided a charging type power source 31, controller 32 and motor 33. The power source 31 is charged from a solar panel 34 arranged on the upper surface of tail end of the long hand 17 and supplies electricity to a driving circuit 35 of the controller 32 and motor 33. The controller 32 transmits a driving pulse to the driving circuit 35 of the motor 33.

The pulse is generally transmitted at the ratio of one time/one minute, and the motor 33 rotates the long hand 17 one rotation per hour on the countershaft 7 through a reduction gear 36. The solar panel 34 may be arranged at any location of any hand, however, it is preferable to arrange it on the outer surface where the sunlight is easily received.

Figure 3:
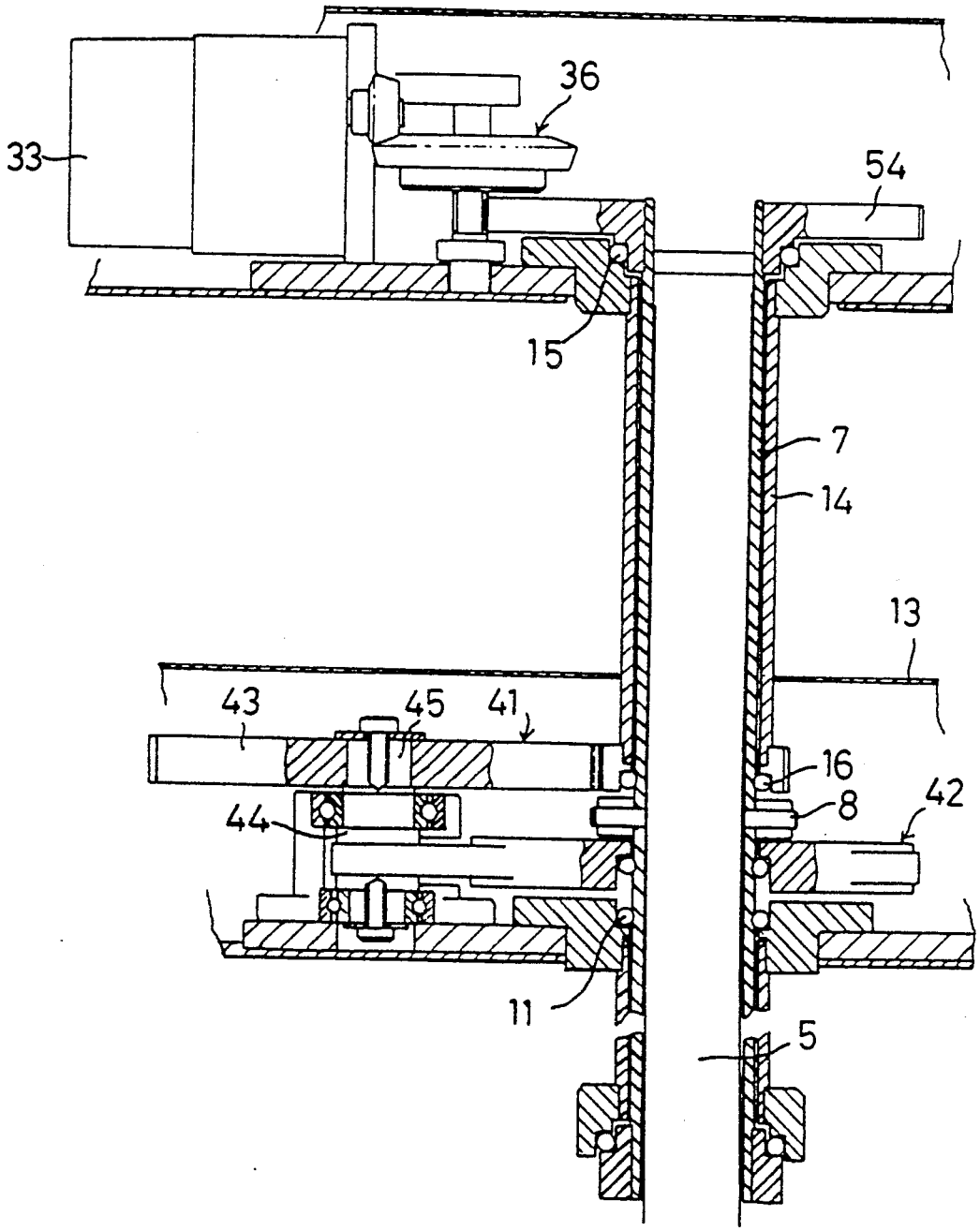
FIG. 3 is an enlarged vertical longitudinal sectional view showing driving mechanisms of a long hand and a short hand of the clock.
Figure 4:
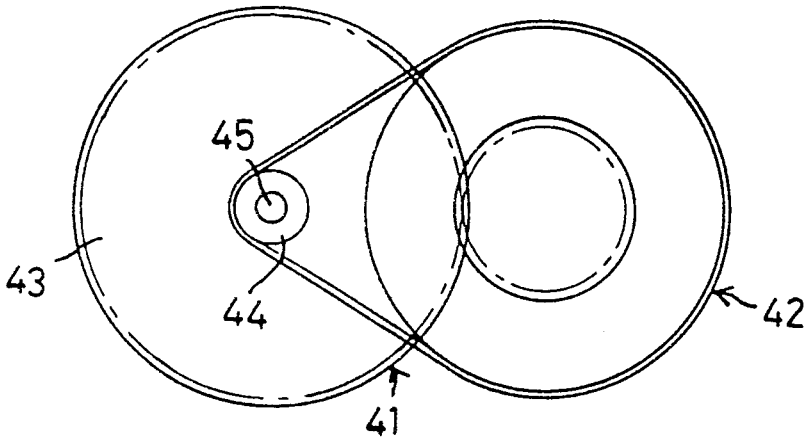
FIG. 4 is a plan view showing a part of the driving mechanism of the FIG. 3.

The lower end of the long hand shaft 14 is positioned in the short hand 13 to be rotated relatively. This portion is connected with the short hand shaft 9 in the short hand 13 through a reduction gear 41 provided in the tail end section of the short hand 13 and a decelerating timing belt 42. A gear 43 and pulley 44 are rotatably supported by a shaft 45 arranged on the short hand 13. The speed reduction ratio between the reduction gear 41 and the decelerating timing belt 42 is set at 11:1. Thus, the rotation of the long hand shaft 14 activated by the rotation of the long hand 17 is transmitted to the short hand shaft 9 through the reduction gear 41 and the decelerating timing belt 42, and the short hand shaft 9 is relatively rotated with the long hand shaft 14. The short hand shaft 9 performs one rotation in twelve hours with the short hand 13 relative to the countershaft 7 (FIGS. 3 and 4).

There is provided a motor 51 near the center of rotation in the long hand 17. The motor 51 is connected with the lower end portion of the second hand shaft 18 located in the long hand 17 through a decelerating belt 50 and rotates the second hand 21 rotate one rotation in one minute relative to the countershaft 7. The time is thus indicated by movement of each hand 13, 17 and 21, and letter indication 52 shown in the FIG. 1.

In the long hand 17, there is provided a sensor 53 for detecting the long hand 17 when it has reached the position of 12 o'clock relative to the letter indication 52. The sensor 53 is composed of a reed switch and is mounted on the long hand 17. The switch is turned on when the sensor has detected a pin 55 on a gear 54 which is fixed, and a signal is transmitted.

In the long hand 17 and short hand 13, there are also provided sensors 56 to detect both hands when they are mutually positioned at the same rotational position. The sensor 56 is a photosensor composed of a light emitting device 56*a* and a light receiving device 56*b*. However, in place of the photosensor, the above-described reed switch may also be utilized. Conversely, the photosensor may also be utilized in place of the sensor 53 of said reed switch.

Figure 2:
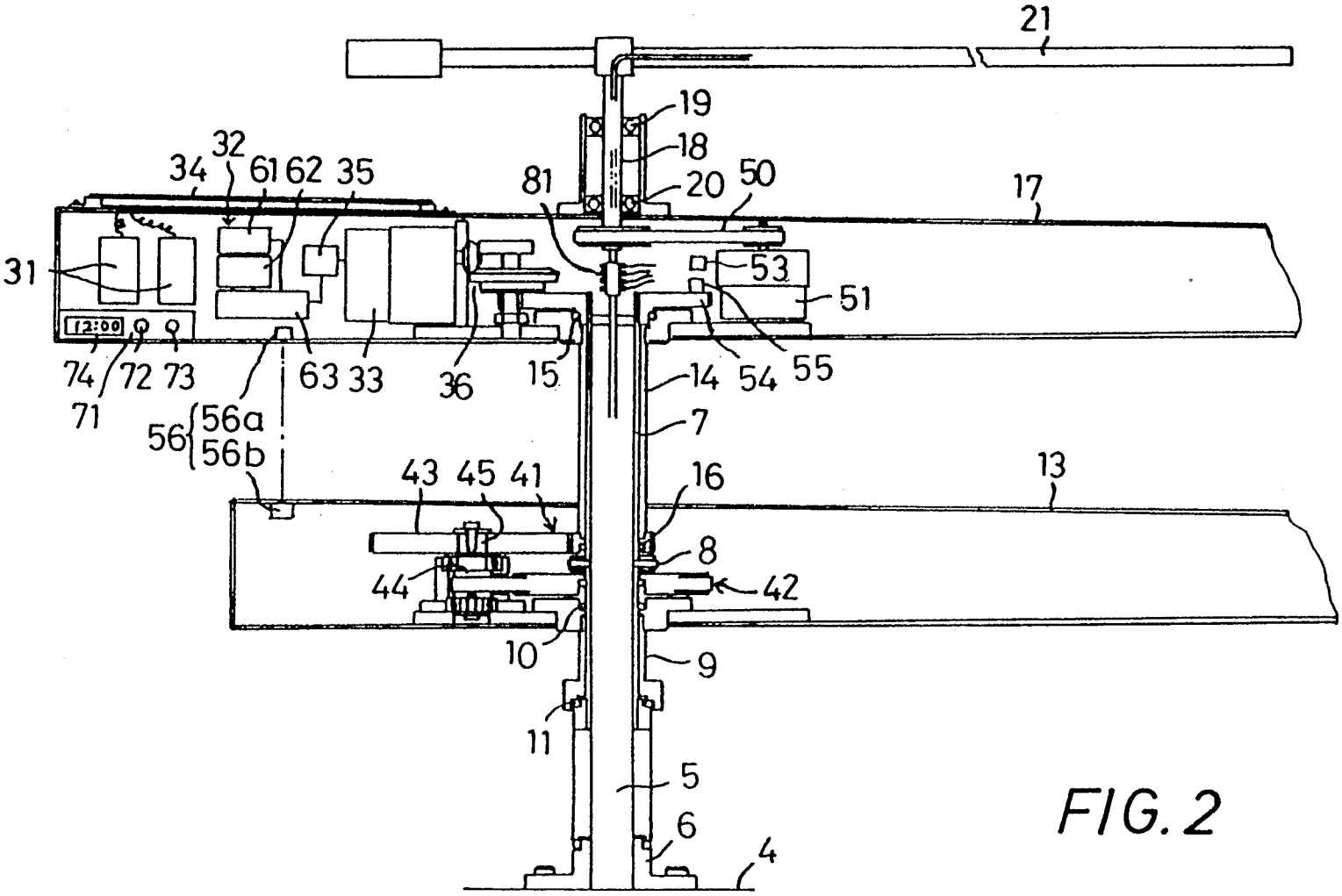
FIG. 2 is a longitudinal sectional view of a clock.

The controller 32 comprises, as illustrated in the FIG. 2, an oscillator 61 for oscillating the clock in the same frequency as that of the pulse, a counter 62 for counting it and a control circuit 63 which receives the count value from the counter 62, detected signals from each of the sensors 53 and 56, and clock from the oscillator 61. The control circuit 63 normally receives pulse signals from the counter 62 every one minute and supplies electricity for each of the pulse to the driving circuit 35 whereby the rotation of the long hand, one rotation in an hour, is performed by intermittent rotation of every one minute. When the control circuit 63 has coincidentally received twelfth hour count signal and signals from the sensors 53 and 56, the hands 13 and 17 are considered to be at the normal positions. At this time, the control circuit 63 maintains the transmission of motor driving pulse as usual.

However, when signals from the sensors 53 and 56 are delayed, the motor 33 is continuously rotated by maintaining the motor driving pulse under the state of continuous supply of electricity. The delay of the hands 13 and 17 is thereby solved since the rotation of the long hand 17 and short hand 13 is extremely speeded up more than usual. When the hands 13 and 17 is have reached the position of twelve o'clock and signals from the sensors 53 and 56 are received, the control circuit 63 returns motor driving pulse to an ordinary state of operation.

When the hands 13 and 17 are rotated fast and signals from the sensors 53 and 56 are inputted earlier than the twelve o'clock signal from the counter 62, an output of motor driving pulse is temporarily suspended. Accordingly, the hands 13 and 17 are stopped at the position of twelve o'clock. Upon receiving the twelve o'clock signal from the counter 62, motor driving pulse is returned to an ordinary state. With such control as described above, the positions of the hands 13 and 17 are always corrected at the point of time of twelve o'clock.

An operation panel 71 is connected to the controller 32. On the operation panel 71, the time counted by the counter 62 is indicated through a window 74. The time indicated is reset so as to make it the most nearest time to the present time by operating an hour reset button 72 provided on the operation panel 71. At this stage, the value counted by the counter 62 is reset at the time rectified. Accordingly, the positional control of the hands 13 and 17 is conducted on the basis of the reset time. In brief, when the button 72 is pressed on the hour, positions of the hands 13 and 17 can be rectified.

On the operation panel 71, there is also provided a count reset button 73. When the count reset button 73 is pressed, the time indicated is reset at just 12 o'clock, and count value of the counter 62 is simultaneously reset at just 12 o'clock as well. In brief, when the button 73 is pressed, positions of the hands 13 and 17 can be rectified at the initial position of 12 o'clock.

In the case when power source and control signal are taken in from the outside and when electrical signals and the like are transmitted and received between each one of the hands, it may be arranged to electrically connect with electrical equipment equipped for each one of the hands by adopting a brush mechanism 81 or the like shown in the FIG. 2. It may also be arranged to change a design so as to make the driving mechanism of the hands 13 and 17 independent and separately equip them with the hands 13 and 17.

The driving mechanism which is provided with a driving source and the driving mechanism which is not provided with a driving source may be connected with each other directly or indirectly as occasion requires. The driving source, concrete structure of driving mechanism and concrete structure of supporting mechanism of each hand and the like may also be variably changed. The number of hands may also be changed variably according to the requirement.

As it is clear from the description made above, according to the present embodiment, the driving mechanisms equipped for each one of the hands drive each hand to the necessary direction by relative rotation with the rotative shaft on which each hand is rotatably supported and cause each hand clocking rotation so that the whole clock mechanism may be arranged outside the support base on which the rotative shaft is supported. The installation and repair as well as maintenance operations can thus be easily performed at a low cost. Flower can be planted even at the central part of the base of the clock because there is not the driving mechanism thereat. Since the driving mechanisms are independently mounted on each hand and they can be decomposed separately, it contributes to easier maintenance operation.

According to the present embodiment, the driving mechanism is housed in a hand, and it rotatively drives the hand without exposing itself to the outside. Simple indication may therefore be made with the same appearance as an ordinary clock. The driving mechanisms are covered by each hand so that they are protected from wind and rain, dust and the like, and sufficient durability can be obtained. It is also advantageous that any special case is not required for the driving mechanisms.

Accordingly to the present embodiment, each hand is equipped with a driving mechanism, and one of the driving mechanisms is provided with a driving source. The driving mechanism which is provided with the driving source is connected with other driving mechanisms by speed ratio according to the speed ratio of each hand so that one driving source can be utilized for common use to drive each hand at the rotational speed each hand requires. The driving mechanisms and control can thus be arranged simply and easily to lower various costs.

Moreover, according to the present embodiment, a solar panel is mounted as a power source for the driving source on the upper surface of the hand which is equipped with the driving source so that the driving source is fully driven by receiving sunlight as a source of energy. The cost can therefore be curtailed. Since the power source and driving source can be connected with each other in the same hand, the connecting structure may be arranged simply at a low cost, and maintenance operation can be performed easily.

Further, according to the present embodiment, each one of the driving mechanisms is provided in the location extending from the rotative shaft section to the tail end side section of each hand, and the weight on the tail end side can be increased without changing the length so that the weight balance between the leading end side and the tail end side of each hand bounded by the rotative shaft can be satisfied without using any special balancing member. Stabilized operation can thus be performed with a simple structure, and a high precision clock can be provided at a moderate price. Since any special balancer is not required, the weight of the whole body is lightened, and it is advantageous to transport and installation operations.

Figure 5:
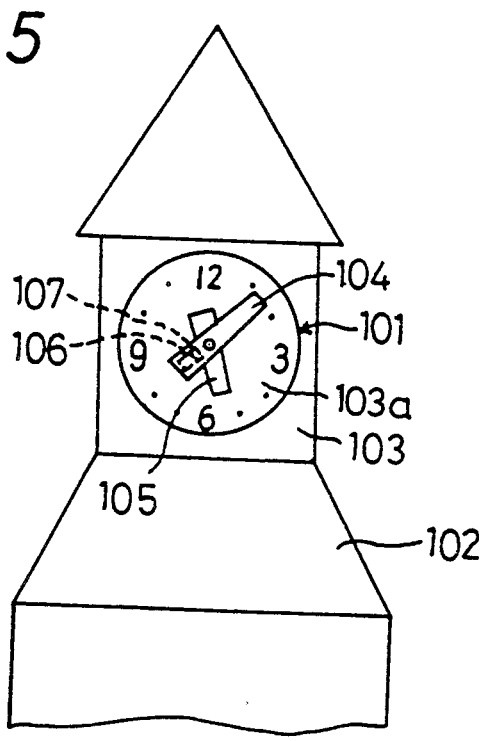
FIG. 5 is a front view showing an example of a tower clock to which the present invention is applied.
Figure 5:
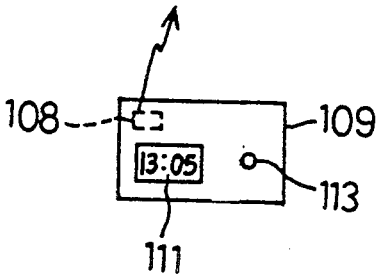

FIG. 5 shows an example of a tower clock to which the present invention is applied.

A clock 101 in this embodiment is installed on an external wall 103 as a base which is on the pointed end portion of a tower 102, and a dial 103*a* is formed on the external wall 103. A driving mechanism which drives a long hand 104 and short hand 105 is the same as that of the one described in the previous embodiment, and therefore, description and drawing of the driving mechanism will be omitted. A control circuit 106 which controls the driving mechanism is provided with a receiving circuit 107 which is the only difference between the driving mechanism of the previous embodiment.

The control circuit 106 can be operated from the ground by a remote controller 109 which is provided with a transmitting circuit 108. In the controller 109, there are provided a indication window 111 for indicating the time counted by a counter in the control circuit 106 and a count reset button 113 which is provided with the same function as that of the one described in the previous embodiment.

The button 113 is operated when the time indicated by the clock 101 is different from the reliable correct-time casting at the point of time of twelve o'clock as described in the previous embodiment. In this case, an operating signal is transmitted to the receiving circuit 107 from the transmitting circuit 108, and the time is regulated at twelve o'clock by the action of the control circuit 106 according to the operating signal.

The method of the above-described remote control may be applied to the previous embodiment. Various devices can be adopted into the remote control. For instance, the indication window 111 can be provided. In this case, the size for recognizing the time from the remote control site is required, however, the structure becomes simple.

When the present invention is applied to the tower clock as described above, an operation room which has been provided at the back of a conventional clock 101 is no longer necessary, and the clock can be disassembled and repaired from the outside. In this embodiment, the time indicated can be regulated by the remote control from the ground.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A large-sized clock comprising:

a face having a plurality of time-indicating numbers, a stationary shaft disposed centrally of said face;

a minute hand mounted for rotation about said shaft and including a tail end and a leading end, said leading end being spaced farther from said shaft than said tail end, said minute hand being hollow and forming a minute-hand tail space between said shaft and said tail end;

an hour hand mounted for rotation about said shaft and including a tail end and a leading end, the latter being spaced farther from said shaft than the former, said hour hand being hollow and forming an hour-hand tail space between said shaft and said tail end of said hour hand;

a first drive means for driving said minute hand comprising an electric motor and a first gearing mounted to said minute hand and disposed in said minute-hand tail space, said electric motor rotating said first gearing, said first gearing meshing with teeth connected to said stationary shaft so that rotation of said first gearing causes said minute hand to rotate about said stationary shaft;

a second drive means for driving said hour hand comprising:

a rotary shaft mounted for rotation about said stationary shaft and connected to said minute hand for rotation therewith, said rotary shaft including a portion extending into said hour hand, and a second gearing mounted to said hour hand and disposed in said hour-hand tail space, said second gearing being operably connected to said section of said rotary shaft to rotate said hour hand in response to rotation of said minute hand;

control means mounted in said minute-hand tail space and operably connected to said electric motor for controlling the operation thereof, and a storage cell type electric power source disposed within said minute-hand tail space and operably connected to said electric motor and said control means for providing electric power thereto.

2. A large-sized clock according to claim 1, wherein said secodn drive means includes a timing belt operably connected to said second gearing and to a rotary wheel which is rotatably mounted for rotation about said shaft.

3. A large-sized clock according to claim 1 including a solar panel mounted on an outer surface of said minute hand within the region of said minute-hand tail space, said solar panel being operably connected to said storage cell-type electric power source.

4. A large-sized clock according to claim 1, wherein said motor is operable at a first speed for normal operation, a second speed faster than said first speed, and zero speed, sensing means for providing a first signal when said minute and hour hands are superimposed at the same position, said control means including means for providing a second signal when said minute and hour hands should be superimposed and for comparing said first and second signals to operate said motor at said second speed when said minute and hour hands are not superimposed when they should be, in order to bring said minute and hour hands into superimposed relationship, and to operate said motor at zero speed when said minute and hour hands are superimposed before they should be.

5. A large-sized clock according to claim 1 including a seconds hand disposed such that said minute hand is situated between said hour hand and said seconds hand, an additional electric motor mounted in said minute hand and connected to said seconds hand for rotating said seconds hand.

6. A large-sized clock according to claim 5, wherein said seconds hand is mounted for rotation on a shaft which is aligned with said stationary shaft.

* * * * *